United States Patent [19]

Oliphant

[11] 3,977,848

[45] Aug. 31, 1976

[54] ELECTROSTATIC PRECIPITATOR AND GAS SENSOR CONTROL

[75] Inventor: Kenward S. Oliphant, San Francisco, Calif.

[73] Assignee: CRS Industries, Inc., Tampa, Fla.

[22] Filed: Apr. 15, 1974

[21] Appl. No.: 460,890

[52] U.S. Cl. ..... 55/105; 55/139; 55/149; 317/262 AE

[51] Int. Cl.[2] ..... B03C 3/04

[58] Field of Search ..... 55/101, 104, 105, 106, 55/124, 136, 137, 138, 139, 140, 149, 150, 151, DIG. 25, 123; 317/262 AE, 4, 262 R, 3; 98/DIG. 1, 50, 1 R; 60/275, 279; 299/12; 239/3, 15; 296/1, 63; 128/419, 190; 21/74

[56] References Cited

UNITED STATES PATENTS

| | | | |
|---|---|---|---|
| 1,472,231 | 10/1923 | Schmidt | 55/129 |
| 2,610,699 | 9/1952 | Penney et al. | 55/138 |
| 3,634,818 | 4/1953 | Wintermute | 55/138 X |
| 3,892,544 | 7/1975 | Haupt | 55/139 |

FOREIGN PATENTS OR APPLICATIONS

| | | | |
|---|---|---|---|
| 701,855 | 1/1954 | United Kingdom | 55/139 |
| 809,397 | 2/1959 | United Kingdom | 55/DIG. 25 |

*Primary Examiner*—Bernard Nozick
*Attorney, Agent, or Firm*—Stefan M. Stein

[57] ABSTRACT

An electrodynamic gas charge system comprising at least one electrically charged element and screen element arranged relative to each other to form a voltage gradient therebetween wherein the system includes means to vary the voltage gradient between the electrically charged element and screen element, the elements being disposed across a gas flow such that particles of dissimilar substances are separated by the charged force field and recombined with like particles.

22 Claims, 7 Drawing Figures

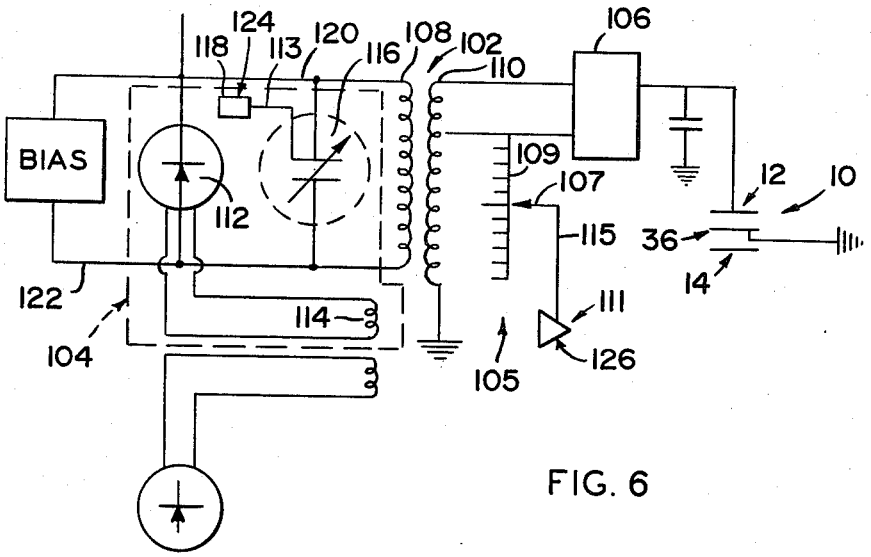
FIG. 6
FIG. 7
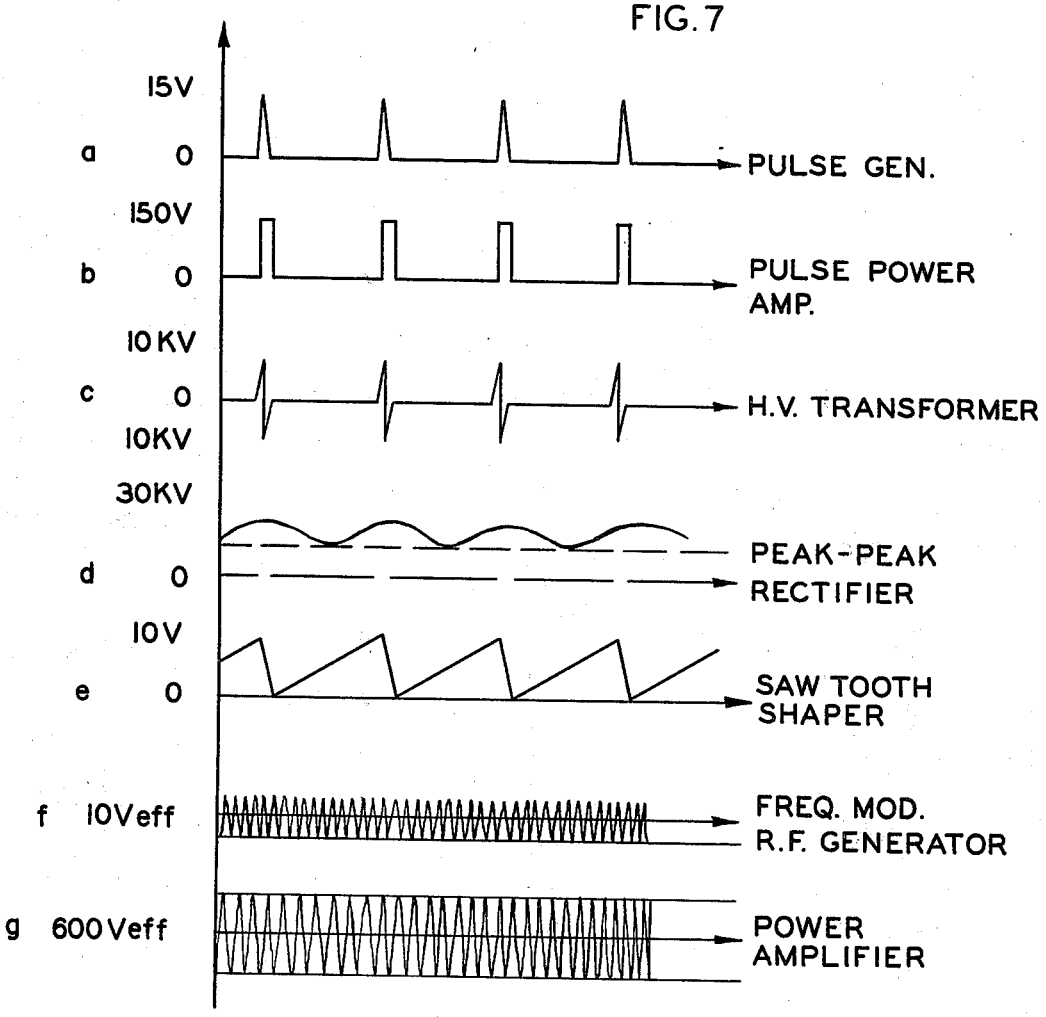

ELECTROSTATIC PRECIPITATOR AND GAS SENSOR CONTROL

BACKGROUND OF THE INVENTION

1. Field of the Invention

An electrodynamic gas charge system to separate combined particles of dissimilar substances and recombined with particles of similar substance.

2. Description of the Prior Art

The science of contamination control has rapidly advanced in the past several years. It has been determined that over 98.5 per cent of atmospheric dust and contaminates comprise fine particles (¾ of micron and smaller). These fine particles will not settle out but remain suspended in the atmosphere subject to several environmental forces. Recently it was discovered that these particles are electrostatically charged which generates an electrostatic force of normally positive potential. As a result, the positively charged fine particles will be attracted or driven to any surface or mass of lower electrical potential. Thus precipitation of these fine particles on surfaces will occur. Commonly, these surfaces and/or masses of lower electrical potential, refer to surfaces such as walls, ceilings, furnishings, clothing, products, processes and people.

Recently a massive filter system was developed which replaced the entire ceiling area or one wall surface of a given room or enclosed area. This system replaces the air in the room once every minute eliminating any secondary air mixture within the room. In reality, the room becomes merely an extension of the air handling or conditioned system plenum. Control of contamination is thus achieved by eliminating the primary and secondary air dilution process used in the more common air conditioning systems. Unfortunately, this is neither a practical nor economical contamination control for the majority of air conditioning applications due to the size of the filtration system. In addition, the primary air may itself be a source of contamination.

The more common systems employ a primary and secondary air dilution process. High efficiency filtration is used to remove the maximum number of suspended particles from the primary air supply and minimize the first source of environmental contamination. Unfortunately, this has a minimum effect upon internal contamination created by infiltration and internal generation of the fine particles. A limited degree of control may result from recirculation of secondary air through filters or other absorptive devices. Normally the effect is limited due to the ratio of secondary to primary air. The most recent advances in contamination control has been the agglomerating of these fine particles into larger masses that can be filtered from the conditioned space. This is commonly accomplished by subjecting the fine particles to a plurality of voltage source fields of varying gradients. Unfortunately, as environmental conditions change during the operation of the system the efficiencies vary due to the operating electrical characteristics.

Even where voltage source fields of varying gradients are employed, excessive voltages (energy levels) generate ozone and corona. Since the presence of even a small amount of ozone is extremely toxic, such systems are severly limited over their operating range.

Thus, a need exists for an efficient and effective agglomerating system capable of varying operating characteristics in response to environmental conditions and reduce noxious stack gases.

SUMMARY OF THE INVENTION

This invention relates to an electrodynamic gas charge system. More specifically, the system comprises a plurality of electrically charged elements, screen element means and means to vary the voltage gradients between the plurality of electrically charged elements and screen element means.

The plurality of electrically charged elements comprises a first and second electrode means in parallel spaced relationship relative to each other with the screen element means comprising an electrically neutral grid disposed therebetween.

The means to vary the voltage gradients between the electrically charged elements and grid may comprise a mechanical means including a sensor means and mechanical adjustment means operatively coupled between the sensor means and first and second electrically charged elements. The sensor means may comprise one or more sensors disposed downstream of the electrically charged elements to sense and measure the performance thereof to generate an output proportional to the variance of such performance against a preselected standard. This output is fed to the mechanical adjustment means to move either or both first and second electrodes relative to the grid to vary the voltage gradient therebetween. By adjusting the voltage gradients, the ionization process may be controlled.

Alternately in a second embodiment, the means to vary the voltage gradient may comprise a signal generator means including a pulse generator means operatively coupled to a first and second output signal generator means.

The first output signal generator means includes a pulse DC generator that generates a high voltage pulsed DC output signal. This PDC signal is fed to the first electrode means which in combination with the neutral grid generates a first variable voltage gradient field. The first output signal generator means includes means to vary the pulse width, maximum peak voltage and DC to AC peak voltage ratio.

The second output signal generator means includes a frequency generator means to generate an RF modulated output signal in response to the output of the pulse generator means. This RF modulated signal is fed to the second electrode means to generate a second variable voltage gradient field. contaminants When used with a closed area, the electrodynamic gas charge system does not replace existing filters; it merely allows existing filters which interrupt contaminants to operate more effectively by agglomerating the suspended particles into large particles. Alternately, the system may be placed in an exhaust stack to reduce contaiminants from noxious exhaust gases passing therefrom.

In operation, the electrodynamic gas charge system may be positioned within duct work through which the gases pass. In general, a filter or collecting device other than an electrostatic device is disposed upstream from the system to mechanically intercept and remove particle pollutants exceeding a predetermined size from the gas. However, because of the effective filter sizes, many of the submicron particles are not trapped. The system agglomerates these smaller particles into larger particles so that on recirculation of the gas through the duct work the agglomerated particles are trapped by the collecting device. Of course, the collecting device may be positioned downstream of the system so that agglomeration takes place before the initial collecting. Alternately, a collecting device may be placed at both ends of the system.

As previously described, the voltage gradients between the first and second electrodes and the neutral grid may be varied mechanically or electrically. Since the electric potentials and masses of particles vary over a wide range, these variable gradient fields increase the probability of particle agglomeration. As a result, combined particles of dissimilar substances are separated and recombined with particles of like substances with greater efficiency. The recombined particles are then electrically charged as the particles flow from the system. Since the voltage gradients may be varied, greater ionization and operating efficiency may be realized.

Thus, the system enhances particle filtration and operates to control the deposit of fine particles within the conditioned space joining these fine suspended particles into suspended agglomerates which are collected by a filter element. In addition, odor control is achieved by the reduction of suspended fine particles carrying odorous parasites.

Alternately, when the system is used with an exhaust stack or other gaseous effluent systems, noxious gas particles are separated and recombined as particles of like substances and ionized as the particles pass through the stack or system.

This invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description, taken in connection with the accompanying drawings in which:

FIG. 6 is a detailed schematic of the pulse generator means.

FIG. 7 is a family of wave forms of the system operation.

Similar reference characters refer to similar parts throughout the several views of the drawings.

DETAILED DESCRIPTION OF THE PREFERRED EMBODIMENT

Figure 1:
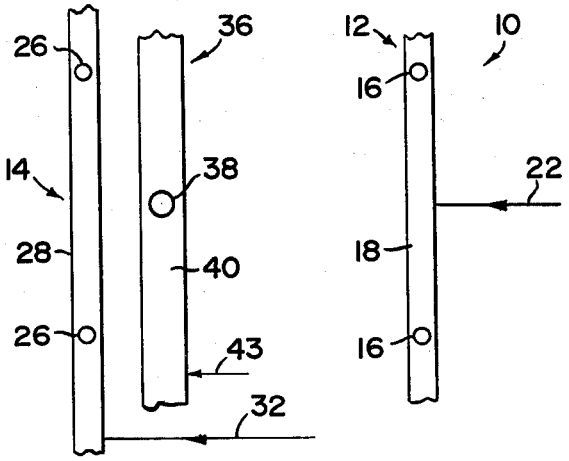
FIG. 1 is a top view of the electrodynamic gas charge system.
Figure 2:
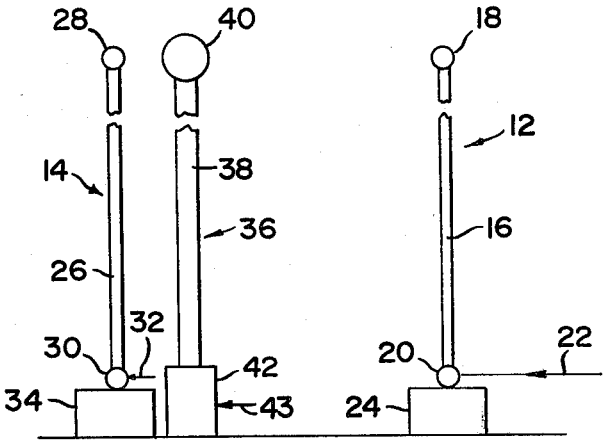
FIG. 2 is a side view of the electrodynamic gas charge system.

As best shown in FIGS. 1 and 2, the present invention comprises an electrodynamic gas charge system generally indicated as 10. System 10 comprises first and second electrically charged elements or electrode means 12 and 14 respectively coupled to an electrodynamic signal generator means as more fully described hereinafter.

Electrodynamic gas charge system 10 is configured to be positioned in duct work or exhaust stack or other gaseous effluent systems through which contaminated gas passes. When used in combination with duct work a filter or collecting device (not shown) is disposed across the gas flow to mechanically intercept and remove the pollutant particles. However, many of the sub-micron sized particles are not trapped but pass through the filter. In operation, as described more fully hereinafter, system 10 separates particles of dissimilar substances which then recombine with particles of like substancs. These particles are then electrically charged with negative potential such that upon recirculation through the closed area the particles agglomerate into larger particles which are collected by the filter. However, the system is not necessarily limited to negatively charged potential.

Alternately, when used with an exhaust stack or other gaseous effluent systems, noxious gas particles of dissimilar substances are separated and recombined as particles of like substance. These particles are then electrically charged and passed from the stack or system into the atmosphere.

Commonly, ionization type contamination control systems comprise various fixed voltage gradient fields. Unfortunately, maximum system effectiveness requires maximum ionization without generating ozone or corona. However, the ionization rate may change with changes in gas environment such as temperature, pressure and humidity as well as the amount and type of pollutants within the gas. The present invention includes means to sense the effectiveness of the system and control the voltage gradient fields to maximize ionization while preventing generation of ozone and corona.

As shown in FIGS. 1 and 2, first electrode means 12 comprises a plurality of substantially vertical electrodes 16 held in fixed parallel spaced relation relative to each other by substantially horizontal upper and lower interconnecting members 18 and 20 respectively. Electrode means 12 is coupled through conductor 22 to a PDC voltage signal as more fully described hereinafter. Lower interconnecting member 20 movably rests on insulated block or support means 24.

Second electrode means 14 comprises a plurality of substantially vertical members 26 held in fixed spaced relation relative to each other by substantially horizontal upper and lower members 28 and 30 respectively. Electrode means 14 is connected through conductor 32 to an RF voltage signal as more fully described hereinafter. Lower interconnecting member 30 movably rests on insulated block or support means 34.

Screen element means 36 comprises a plurality of substantially vertical elements 38 held in fixed parallel spaced relation relative to each other by upper and lower interconnecting members 40 and 42 respectively. Lower member 42 is coupled to a ground or lower voltage potential than electrode means 12 and 14 through conductor 43 to form a neutral grid.

Figure 3:
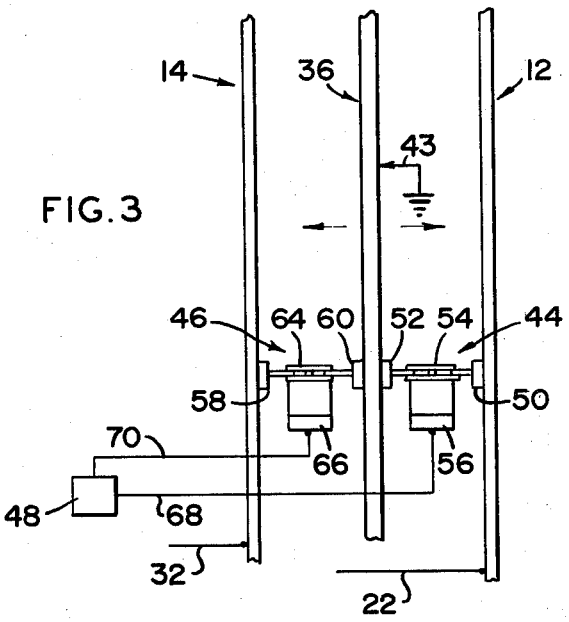
FIG. 3 is a detailed view of the mechanical adjustment means.

As best shown in FIG. 3, first and second electrode means 12 and 14 respectively are coupled to screen element means 36 by a first and fourth servo mechanism 44 and 46 respectively. The first embodiment of control means comprises the first and fourth servo mechanism 44 and 46. Sensor means 48 is disposed downstream of first and second electrode means 12 and 14 respectively. Sensor means 48 may be of the type capable of determining any one or more of a number of parameters or characteristics. For example, sensor means 48 may comprise a space charge sensor, ozone sensor, corona sensor, odor sensor, particle density sensor or obscuration sensor. Alternately, more than one sensor means 48 may be used to sense any one of a plurality of these or other parameters. Sensor means 48 includes standard logic to compare the sensed parameter to a preselected value and generate an output signal in response thereto. First servo mechanism 44 comprises attachment means 50 and 52 affixed to first electrode means 12 and screen means 36 respectively. Attachment means 50 and 52 are interconnected by interconnecting linkage 54 which is operatively coupled to motor means 56. Fourth servo mechanism 46 comprises attachment means 58 and 60 affixed to second electrode means 14 and screen element means 36 respectively. Attachment means 58 and 60 are interconnected by interconnecting linkage 64 which is operatively coupled to motor means 66. Sensor means 58 is coupled to motors 56 and 66 through conductors 68 and 70 respectively. Sensor means 48 is set to a preselected reference such that as the sensed parameter varied from the preselected reference or standard, sensor means 48 generates an output signal proportional to the change in the sensed parameter. This signal is fed to motors 56 and 66 to move first and second electrode means 12 and 14 relative to screen means 36 to vary the voltage gradient fields therebetween. Sensor means 48 continues to generate a correction or adjustment signal until the preselected reference is reached. Thus, as environmental conditions change the voltage gradients are varied to maximize the negative ionization process without falling below the minimum acceptable standards of one or more of the above sensed parameters.

Figure 4:
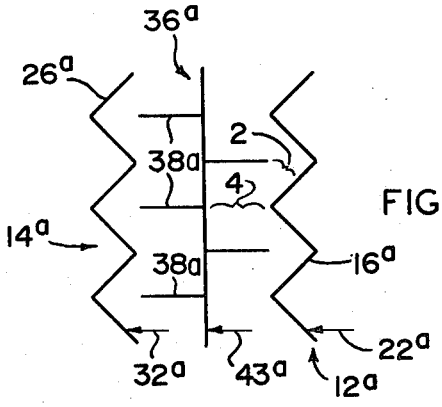
FIG. 4 is a top view of an alternate electrodynamic gas charge system.

FIG. 4 shows an alternate configuration for the PDC and the RF electrode means, and screen means. As shown therein, first electrode means 12*a*, second electrode means 14*a* and screen means 36*a* each comprises a plurality of elements disposed in angular relationship relative to the gas flow to increase the effective contact area between the gas flow and the system. Specifically, first electrode means 12*a* comprises a continuous electrode 16*a*, second electrode means 14*a* comprises a continuous electrode 26*a* and screen means 36*a* comprises a plurality of elements 38*a*. The position of elements 38*a* relative to electrodes 16*a* and 26*a* generate a converging voltage gradient therebetween.

Figure 5:
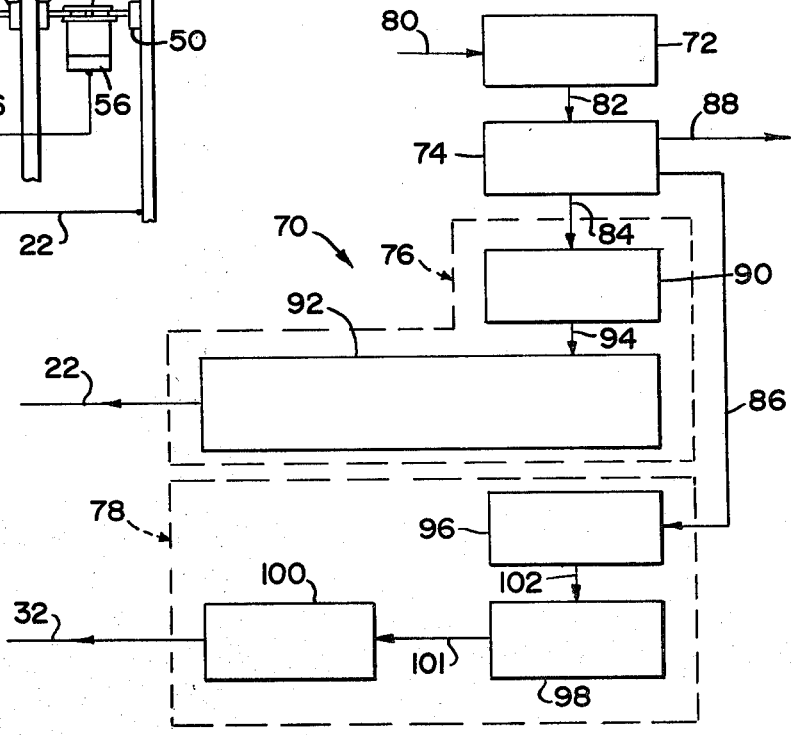
FIG. 5 is a block diagram of the signal generator means.

FIG. 5 is a block diagram of signal generator menas 70 comprising power supply means 72, pulse generator means 74, first output signal generator means 76 and second output signal generator means 78.

Power supply means 72, connected to a standard 120 volts AC source though conductor 80, generates the necessary DC supply voltages to operate the system. The DC voltage output of power supply means 72 is coupled through conductor 82 to pulse generator means 74 which generates a pulsed DC output signal (FIG. 7*a*). These signals are fed simultaneously to first and second output signal generator means 76 and 78 respectively through conductors 84 and 86 respectively. The pulse generator means 74 output signal may be coupled to additional systems (not shown) through conductor 88.

As shown in FIG. 5, first output signal generator means 76 comprises power amplifier means 90 and pulsed DC voltage generator means 92. The output of pulse generator means 74 is amplified by power amplifier means 90 (FIG. 7*b*) and fed to PDC voltage generator means 92 through conductor 94.

Second output signal generator means 78 comprises wave-shaping means 96, radio frequency signal generator means 98 and power amplifier means 100. The output of pulse generator means 74 is fed to wave-shaping means 96 where a saw-tooth signal is generated (FIG. 7*e*). Of course, any number of other wave forms may be used such as a sine wave or square wave. This saw-tooth signal is fed to radio frequency generator means 98 through conductor 102 where a carrier radio frequency output signal is generated (FIG. 7*f*). The output of generator means 98 is then fed as an RF signal through power amplifier means 100 via conductor 101 to electrodes 26 via conductor 32. A number of slaved electrode means 12 and 14 may be operated simultaneously from first and second signal generator means 76 and 78 respectively from the master device 10.

FIG. 7 is a family of curves provided to assist in understanding the operation of the entire system. Thus, while specific values are illustrated, these values are nominal and not considered limiting in any sense.

FIG. 6 shows the second embodiment of the control means and is a schematic of pulsed DC generator means comprising high voltage transformer means 102, second servomechanism 104, third servomechanism 105 and signal amplifier means 106. Transformer means 102 includes primary and secondary windings 108 and 110 respectively. Second servomechanism 104 comprises rectifier means 112, control winding 114, variable capacitor 116 and motor means 118. Third servomechanism 105 comprises contact arm 107, taps 109 and motor means 111. Motor means 118 and 111 are coupled to capacitor 116 and contact arm 107 by linkages 113 and 115 respectively.

The output of amplifier means 90 is imposed across primary winding 108 through conductors 120 and 122. Capacitor 116 and rectifier means 112 are connected across conductors 120 and 122. Second and third servomechanism 104 and 105 respectively are coupled to sensor means 48 through conductors 124 and 126 respectively. By adjusting capacitor 116 by motor means 118, the character of the signal is changed thereby controlling, among other things, the duty cycle and peak voltage. Similarly, the tap off secondary winding 110 may be adjusted by motor means 111 to control the ratio of AC to DC output signal. Thus, as sensor means 48 senses and measures the intended parameter of the sensed gas stream and compares same to the preselected reference, the peak voltage, duty cycle and AC to DC voltage ratio of the pulsed DC signal fed to first electrode means 12 may be adjusted automatically to achieve maximum efficiency.

In operation, the gas is passed through a filter or collecting device (not shown) other than an electrostatic device where the suspended particles are trapped. The small fine particles are carried along with the flow of the gas to system 10. As the particles pass through first electrode means 12, particles of dissililar substances are separated and recombined into particles of like substances by the action of the pulsed DC voltage signal.

As the gas continues through second electrode means 14, the recombined particles are electrically negatively charged. Thus, the system is used to agglomerate smaller particles into larger sized particles so that as the gas recirculates through the closed area, the particles are trapped and removed from the gas. In addition, the odor causing parasites are electrically attracted to the particles.

Alternately, the electrodynamic gas charge system may be used in an exhaust stack or gaseous effluent system. The operation is similar in operation except that noxious gases are separated and recombined into particles of like substances. These particles are electrically charged and passed into the atmosphere.

Thus, the system enhances the particle filtration and operates to control the deposit of fine particles within the conditioned space. In addition, odor control is accomplished by the reduction of suspended particles carrying odorous parasites. These odorous contaminant parasites are attracted to the charged suspended particles in the recirculation system and are separated from the gas along with the aforementioned particles thus reducing the irritation and unpleasant odors from suspended fine particles.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all the generic and specific features of the invention herein described, and all statements of the scope of the invention, which, as a matter of language, might be said to fall therebetween.

Now that the invention has been described,

What is claimed is:

1. An electrodynamic gas charge system configured for operation within a gas stream, said electrodynamic gas charge system comprising a first electrically charged element, a screen element connected to ground so as to be at a lower potential than said first electrically charged element, signal generator means comprising a first output signal generator to generate a first output voltage signal, said first electrically charged element electrically interconnected to said first output signal generator to receive and be electrically charged by said first output voltage signal, said first electrically charged element and said screen element constructed and arranged relative to each other to develop a first voltage gradient field therebetween to ionize and agglomerate particles in the gas stream, sensor means to measure parameters of the gas stream that increase relative to the level of ionization, said sensor means disposed in communicating relationship with the gas stream and including means to generate an output signal proportional to the difference of the measured parameters and a preselected standard control means electrically connected to said sensor means, said control means connected to said first electrically charged element and disposed to vary said first voltage gradient field upon receipt of an output signal from said sensor means, whereby maximum ionization is allowed without exceeding said preselected standards.

2. The electrodynamic gas charge system of claim 1 wherein said control means further includes a first servomechanism coupled between said first electrically charged element and said screen element, said first servomechanism coupled to said sensor means to receive output signals therefrom, said first servomechanism including means to move said first electrically charged element relative to said screen element in response to said signal from said sensor means to vary said voltage gradient field.

3. An electrodynamic gas charge system as in claim 1 wherein said sensor means is disposed downstream relative to said first electrically charged element and said screen element.

4. The electrodynamic gas charge system of claim 1 wherein said first output voltage signal comprises a pulsed DC voltage signal.

5. The electrodynamic gas charge system of claim 4 wherein said pulsed DC voltage signal comprises DC voltage component and AC voltage component imposed thereon.

6. An electrodynamic gas charge system of claim 5 wherein said control means further includes a second servomechanism coupled to said signal generator means, said second servomechanism including means to vary the duration of said first output signal in response to said signal from said sensor means to vary said voltage gradient field, said signal generator means being electrically interconnected to said first electrically charged element by way of said control means.

7. The electrodynamic gas charge system of claim 6 wherein said second servomechanism means includes means to vary the peak voltage of said output signal.

8. The electrodynamic gas charge system of claim 5 wherein said control means further includes a third servomechanism, said third servomechanism includes means to vary the ratio of the DC to AC component of said first output signal to vary said voltage gradient field.

9. The electrodynamic gas charge system of claim 1 wherein said system further includes a second electrically charged element and said signal generator means includes a second output signal generator means generating a second output voltage signal, said second electrically charged element coupled to said second output signal generator means to receive said second output voltage signal, said second electrically charged element and said screen element arranged relative to each other to generate a second voltage gradient field therebetween.

10. The electrodynamic gas charge system of claim 9 wherein said control means further includes a fourth servomechanism coupled between said second electrically charged element and said screen element, said fourth servomechanism coupled to said sensor means to receive output signals therefrom, said fourth servomechanism including means to move said second electrically charged element relative to said screen element in response to said signal from said sensor means to vary said voltage gradient field.

11. The electrodynamic gas charge system of claim 9 wherein said second electrically charged element comprises a second plurality of charged electrodes disposed across the gas stream and said screen element comprises at least one neutral element disposed adjacent said second plurality of charged electrodes to generate said second voltage gradient field therebetween.

12. The electrodynamic gas charge system of claim 11 wherein said second plurality of charged electrodes are held in fixed spaced parallel relationship relative to one another by interconnecting means and said screen element comprises a plurality of elements held in fixed spaced parallel relationship relative to one another by interconnecting means.

13. The electrodynamic gas charge system of claim 11 wherein said second plurality of charged electrodes are arranged in an angular pattern relative to each other and to said screen element.

14. The electrodynamic gas charge system of claim 13 wherein said angular pattern is substantially W-shaped.

15. The electrodynamic air filter system of claim 9 wherein said signal generator means further includes pulse generator means coupled to said first and second output signal generator means to generate said first and second output voltage signals.

16. The electrodynamic air filter system of claim 15 wherein said second output signal generator means comprises modulator signal generator means to generate said second output voltage signal in response to the output of said pulse generator means.

17. The electrodynamic air filter system of claim 16 wherein said second output voltage signal comprises a modulated voltage signal.

18. The electrodynamic air filter system of claim 17 wherein said second output signal generator means includes a wave shaping means coupled between said pulse generator means and said modulator signal generator means to modulate said second output voltage signal.

19. The electrodynamic gas charge system of claim 1 wherein said first electrically charged element comprises a first plurality of charged electrodes disposed across the gas stream and said screen element comprises at least one neutral element disposed adjacent said first plurality of charged electrodes to generate said first voltage gradient field therebetween.

20. The electrodynamic gas charge system of claim 19 wherein said first plurality of charged electrodes are held in fixed spaced parallel relationship relative to one another by interconnecting means and said screen element comprises a plurality of elements held in fixed spaced parallel relationship relative to one another by interconnecting means.

21. The electrodynamic gas charge system of claim 19 wherein said first plurality of charged electrodes are arranged in an angular pattern relative to each other and to said screen element.

22. The electrodynamic gas charge system of claim 21 wherein said angular pattern is substantially W-shaped.

* * * * *

UNITED STATES PATENT OFFICE

CERTIFICATE OF CORRECTION

Patent No. 3,977,848 Dated August 31, 1976

Inventor(s) Kenward S. Oilphant

It is certified that error appears in the above-identified patent and that said Letters Patent are hereby corrected as shown below:

Column 2, line 49, after "Field" delete "contaminants".

Column 5, line 17, "58" should read --- 48 ---.

Column 5, line 35, delete "the".

Signed and Sealed this

Eighteenth Day of January 1977

[SEAL]

*Attest:*

RUTH C. MASON
*Attesting Officer*

C. MARSHALL DANN
*Commissioner of Patents and Trademarks*